US007000705B2

(12) United States Patent
Buyers et al.

(10) Patent No.: US 7,000,705 B2
(45) Date of Patent: Feb. 21, 2006

(54) HYDRAULIC SETTING TOOL WITH PRESSURE MULTIPLIER

(75) Inventors: Mark Buyers, Dyce (GB); David Forsythe, Dyce (GB); Simon Benedict Fraser, Dyce (GB)

(73) Assignee: Omega Completion Technology Limited, Aberdeen (GB)

( * ) Notice: Subject to any disclaimer, the term of this patent is extended or adjusted under 35 U.S.C. 154(b) by 135 days.

(21) Appl. No.: 10/416,057

(22) PCT Filed: Nov. 5, 2001

(86) PCT No.: PCT/GB01/04879

§ 371 (c)(1),
(2), (4) Date: Sep. 3, 2003

(87) PCT Pub. No.: WO02/36930

PCT Pub. Date: May 10, 2002

(65) Prior Publication Data

US 2004/0045724 A1 Mar. 11, 2004

(30) Foreign Application Priority Data

Nov. 3, 2000 (GB) ..... 0026904

(51) Int. Cl.
*E21B 23/04* (2006.01)

(52) U.S. Cl. ..... 166/383; 166/181; 166/386

(58) Field of Classification Search ..... 166/123, 166/181, 182, 381–383, 386, 387
See application file for complete search history.

(56) References Cited

U.S. PATENT DOCUMENTS

| | | | |
|---|---|---|---|
| 3,661,205 | A | 5/1972 | Belorgey |
| 4,845,982 | A | 7/1989 | Gilbert |
| 5,240,077 | A | 8/1993 | Whitsitt |
| 5,791,413 | A | 8/1998 | Buzinsky |

FOREIGN PATENT DOCUMENTS

| | | |
|---|---|---|
| EP | 0446976 | 9/1991 |
| EP | 0500341 | 8/1992 |
| GB | 2315507 | 2/1998 |
| GB | 2334285 | 8/1999 |

*Primary Examiner*—Zakiya Walker
(74) *Attorney, Agent, or Firm*—Madson & Metcalf

(57) ABSTRACT

A hydraulically operated setting tool for use in setting a plug or other component in a wellbore, and which is responsive to a supply of input actuating pressure to actuate the tool. An elongate tool housing has an inlet to receive the supply of actuating pressure, and an actuator element is axially displaceable relative to housing and also engageable with the plug or other component to set and release the component with respect to the wellbore. A pressure multiplier arrangement includes a hydraulically operated low pressure and high volume output piston which performs initial loading of the tool, and a high pressure, low volume output piston which provides a multiplied hydraulic force applied to the actuator element to set the plug or other component in a required position in the wellbore.

13 Claims, 1 Drawing Sheet

HYDRAULIC SETTING TOOL WITH PRESSURE MULTIPLIER

Figure 1:
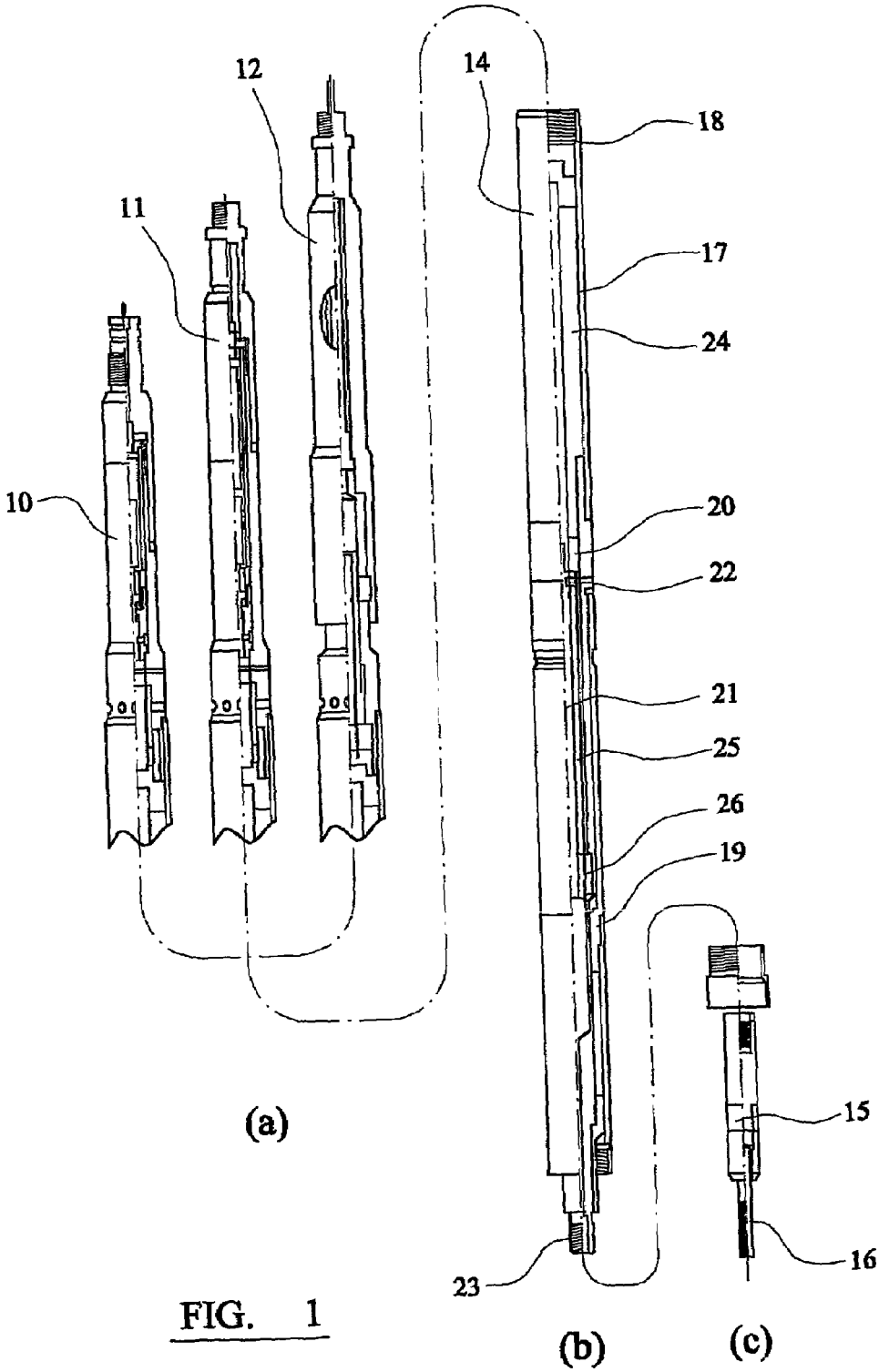

This invention relates to a setting tool for use in a wellbore, and a method of setting a plug in a wellbore.

BACKGROUND TO THE INVENTION

In the petrochemical industries, there are many occasions when repair to a well is required or when flow should be closed off. This is accomplished by use of a device called a plug. This device seals pressure from above and below and normally features a rubber or similar packing element arranged around the outside of the plug, a "slip" mechanism to engage and lock the plug with the metal tubulars of the wellbore and a body to join the elements together. This plug becomes a pressure barrier and allows work to be safely carried out above with no possibility of well fluids escaping. Pressure retaining capability may be as much as 10,000 psi and it may operate in temperatures of 300 deg F. or higher.

Many types of plug exist available in a complete range of sizes and from a multitude of manufacturers. The plugs may be conveyed to the required setting depth in the wellbore on pipe but more commonly on a wireline. When positioned at the required depth, the plug must be set, normally requiring locating pins to be sheared with a moderate force, the slips to be energised, again with a moderate force and the rubber element to be expanded again with moderate force. During this stage of setting, the forces required are only a few thousand pounds but the stroke may be quite long (7 inches or more). Finally, large forces of 20 thousand pounds or more are required (over a short stroke of 1.0" or less) to fully energise the rubber packing element, to force the slips into a biting engagement with the tubing wall and to disconnect the hydraulic power device from the plug.

The generic name for the running tool which provides the large setting forces required is a "setting tool". There are two industry standard setting tools, namely the Baker E4 setting tool and the Halliburton (or GRC as formally known) "Shorty". Both these tools operate using the same method. The method is to create and contain a high pressure gas by igniting a pyrotechnic charge in a closed chamber. The pyrotechnic or "black powder" charge is initiated by application of an electrical current typically of around 20 volts. This is most usually supplied from surface down an electric wireline cable but may also be supplied from batteries used in conjunction with a pre-programmed clock or other memory device which switches the power to the charge. The chamber which contains the high pressure gas features a floating hydraulic piston with an oil filled chamber below splitting the chamber into two sections. The hydraulic oil is pressured by the gas and provides hydraulic power which when diverted to a secondary piston, performs the setting task as described previously. The power generated by the setting tool is available over the entire stroke of the setting tool, the device automatically adjusting to different stroke requirements.

The setting tool is connected to the plug by a "shear stud", normally a threaded rod with a waisted middle to provide a weak point. The shear stud may be rated to as much as 50,000 lbs. Use of the shear stud guarantees the required amount of force has been imparted to the plug below. Following setting, one half of the shear stud will be returned with the setting tool, and the other will remain with the plug.

Following setting, the setting tool will retain the gas pressure until this is relieved. This normally entails opening a valve following recovery on surface. The high pressure gas is vented to atmosphere under controlled conditions. Not only is the handling of a highly pressurised gas containing vessel dangerous, but the venting of the gas is a hazardous operation and must be conducted under strictly controlled conditions.

Many rules and regulations exist regarding the shipping and handling of pyrotechnics as they are part of the family of explosives. Trained personnel are required at every stage and there are many limitations on the use of pyrotechnics, especially regarding air freight. Safety provisions must be made such as storage in licensed premises and many third parties must be involved including notification of the Harbour Master when shipping by sea, regular inspections both by the Fire Brigade, local authority (for licensing requirements) and the Police for security issues. The gas chambers of setting tools must undergo regular N.D.T. inspections for cracks and other damage due to their onerous use.

Obviously, as can be seen from the above, the use of pyrotechnics is to be avoided if at all possible, but there are only limited alternatives at present. One method is to use a "Hydrostatic Setting Tool". This type of tool converts the ambient hydrostatic pressure in a wellbore into an hydraulic force to set the plug. The tool is equipped with a series of pistons which each have atmospheric pressure on both sides of the piston. They are modified pyrotechnic setting tools and retain the hydraulic lower section replacing the gas section with the pistons. When a valve is opened (either by a signal from surface or by a timer device) well pressure is allowed to act upon one side of the pistons causing an imbalance similar to the hydrostatic ambient pressure. As bottom hole well pressures are commonly in the range of 2,000 to 8,000 psi, a straight 1 to 1 ratio will not produce sufficient hydraulic power to set a plug. The pistons must therefore incorporate a pressure multiplier to generate the high pressures needed. Typically a 1 to 5 multiplier may be required. This means therefore that for the volume of hydraulic oil required for the stroke to set the tool, at least 5 times that volume (or stroke) in the well pressure chamber must be present. A contingency of around 50% of the stroke is also required in order that the setting pistons do not bottom out without releasing the shear stud and disconnecting from the plug. This tool is very cumbersome and unwieldy due to its extreme length and its performance is only marginal in certain circumstances. Limited space is available to introduce tools into a wellbore and extreme lengths preclude some tools from operational use. Without increasing the pressure multiplier ratio to perhaps 10 to 1 and increasing the length accordingly, this device has very limited application and is seldom used.

It is an object of the invention, to provide a pressure activated setting tool which can offer all the benefits of a non pyrotechnic setting tool but with the performance, output and short length of the explosive type.

According to the invention there is provided a hydraulically operated setting tool as defined in claim 1.

Preferred aspects of the invention are set out in dependent claims 2 to 11.

As has been stated earlier, the output from a pyrotechnic setting tool is a high pressure gas charge with the high pressure available over the entire stroke. This is due to the compressibility of gas, but is inefficient as around ⅘ of the stroke is used to "take up the slack" in the setting tool and the bridge plug. This includes shearing light retaining pins, expanding elastomers and stroking mandrels to close up gaps. Only a few thousand pounds force is required for this.

Once all the slack has gone and the major movement has finished, high forces are required to energise the slips with the tubing wall, energise the packing element the final portion and to shear the release shear stud. The setting process requires two distinct hydraulic operations, each with different properties. Firstly a long stroke low pressure operation followed by a short stroke high pressure operation.

A Pressure Activated Setting Tool according to the invention is able to combine both these operations in one device and a preferred embodiment will now be described in some detail with reference to FIG. 1 of the accompanying drawings.

Shown in FIG. 1*a*, to the left of the drawing, are the three initiating option modules, namely an adaptor 10 to electric wireline cable, a memory clock type device 11 for slickline use, and a hydraulic connector 12 for use in shallow setting depths. All three of these option modules allow well pressure (or hydraulic pressure supplied from surface in option 3) to selectively enter the tool at the top when initiation is required. The tool (designated generally by reference 14 in FIG. 1*b*) is oil filled and features a rod type central piston (high pressure, low volume) which is detachably connected to an annular type (high volume, low pressure) piston. In the example shown, shear pins of a specific pre determined value interconnect the pistons. A ratchet mechanism at the bottom of the annular piston completes the internal detail of the tool.

In response to well pressure entering the top of the tool, (shown in FIG. 1*b*) the LP piston combined with the HP piston both displace hydraulic oil into an outer sleeve type piston forcing it downwards and causing an attached plug to compress. The centre portion of the plug (not shown) is retained at this time by a shear stud 16 which is shown at the bottom of the illustration with the outer setting tool hydraulic sleeve pressing downwards. The L.P. section of the tool has a ratio of 1 to 2, doubling the available well pressure until such time as all movement has been accomplished with this pressure. The shear connection linking the LP and HP pistons will now shear allowing the HP piston to exert increased loads on the plug. The ratchet arrangement prevents the hydraulic pressure from returning the LP piston back to its starting point and isolates the LP piston from the system. The HP piston has a ratio of 1 to 10 increasing well pressure 10 times. This will now produce the last part of the stroke required to fully set the plug and release the shear stud.

A plug adapter 15, shown in FIG. 1*c* carries the shear stud 16 (which attaches the plug to the tool), and is secured to the lower end of the tool 14.

By use of this method, hydraulic forces well in excess of 50,000 lbs are available to set a variety of plugs without use of pyrotechnics. The device will self compensate for different plug types and will automatically change over from LP to HP operation once the required "slack" has been removed from the system.

The construction of the tool will now be described in detail, with reference to FIGS. 1*a, b* and *c* of the drawing.

The hydraulically operated setting tool is designated generally by reference 14, and is intended to be used in setting a plug or other component in a wellbore, and being responsive to a supply of input actuating pressure to actuate the tool. Any suitable one of the connector modules 10, 11 and 12, shown in FIG. 1*a*, may be used in order to complete the assembly of the tool, ready to be raised and lowered to a required position along the length of the wellbore, via suitable flexible connection to the surface. The module 10 may be used to connect the tool to an electric wireline, whereas the module 11 can be used to connect the tool to a slickline. The module 12 may be used to provide an hydraulic connection to surface, in shallow drilling depths, when a remote input actuating pressure is used in order to actuate the tool. However, in the case of the modules 10 and 11, it will be wellbore ambient pressure which will be used in order to actuate the tool.

The plug adapter 15 is detachably connected to a lower end of the tool 14, and carries shear stud 16 which is the means employed in order to attach a plug (not shown), or other component which is to be set in position in the wellbore.

The tool 14 has an external elongate housing designated generally by reference 17, and which is movable lengthwise during lowering and raising of the tool 14 in the wellbore. Housing 17 has an inlet 18 to receive the supply of actuating pressure which, as mentioned above, may be wellbore pressure, or an external supply of actuating pressure from the surface.

An actuator element is axially displaceably mounted on the housing 17, and the illustrated arrangement comprises an outer hydraulic setting sleeve 19. Sleeve 19 is engageable with the plug or other component, to set and release the component with respect to the wellbore, upon axial displacement of the sleeve 19.

A pressure multiplier arrangement is provided in the housing 17, and comprises a detachable connection together of a low pressure piston 20 and a high pressure piston 21. In the illustrated example, a detachable connection between pistons 20 and 21 takes the form of shear pins 22. However, it should be understood that other means may be utilised in order to provide a detachable connection between pistons 20 and 21, upon application of a predetermined load therebetween.

The void outside the low pressure and high pressure pistons is oil filled via oil fill port 23 (forming a closed chamber).

The pressure multiplier arrangement disclosed is therefore operative, upon supply of actuating pressure to the housing 17 via inlet 18, to provide a low pressure and high volume output to perform the initial loading of the tool 14, and a high pressure, low volume output to provide a multiplied hydraulic force applied to the actuator element (outer hydraulic setting sleeve 19) to set the plug or other component in a required position in the wellbore.

The low pressure piston 20 and the high pressure piston 21 are connected together by a detachable connection, as mentioned above, and which yields under a predetermined load in order to allow the high pressure piston 21 to apply the multiplied hydraulic force to the actuator element.

A ratchet arrangement 26 is mounted in the housing 17, and it has the function of preventing return movement of the low pressure piston 20 after yielding of the connection.

As shown in FIG. 1*b*, the low pressure piston 20 is an annular piston, and the high pressure piston 21 is a rod like piston.

The disclosed embodiment of hydraulically operated setting tool according to the invention can therefore be used to set a plug or other component in a wellbore, and has the advantage of providing the benefits of using a non-pyrotechnic setting tool i.e. avoiding the dangers and inconveniences of using an explosive tool, but having the performance, output and short length associated with use of explosive type setting tools. The hydraulic operation of the tool, upon actuation by supply of input actuating pressure, utilizes two hydraulic chambers, in which one chamber will always be at atmospheric pressure, whereas the other one will be at atmospheric pressure until the tool is operated, and will then be exposed to high pressure from both the low pressure piston 20 and the high pressure piston 21. The plug (not shown) is attached by the shear stud 16, and the two assemblies, housing 17 and adapter 15, are threaded together. The outer "setting sleeve" (19) butts on the outside of the plug, and effectively pushes the plug down, while the shear stud 16 remains anchored to the internal components of the plug, during "setting" of the plug.

Once the plug is fully set, the shear stud 16 will separate (under load of 30,000 lbs or more), and this detaches the plug from the setting tool.

The design of the plug adaptor 15 is not critical, but will be designed according to the particular proprietary type of plug which is utilised.

To conclude, the hydrostatically operated setting tool disclosed herein addresses an industry requirement for a non-pyrotechnic setting device for downhole use. The setting tool converts the hydrostatic pressure at the tool into an axial force. The short overall length of the tool can be achieved by incorporating a high volume low-pressure piston and a low volume high-pressure piston into the setting tool. This hydraulically operated pressure multiplier arrangement, combined with a unique regulating device within the tool, allows the hydrostatic well pressure to be boosted within the tool, providing a force of about 29,000 lbs for each 1,000 psi well pressure. The setting tool has been designed to run on slickline, and also electric line, but can also be adapted for coil tubing and pipe applications. The setting tool can be quickly converted from slickline to electric line deployment on a rig site, by replacing two components at the top of the tool.

When run on slickline, a timer is used, which features an external switch allowing the timer to be started just before the tool string is picked up. A timer disconnect feature is also provided, in the event that the tool string hangs up R.I.H. This feature can be enabled or disabled as required.

In the event of insufficient hydrostatic pressure being available e.g. during low level drilling, a pressure module may be run on top of the setting tool to provide sufficient input pressure. This would only be required if it were not possible to apply pressure from surface.

The hydrostatic setting tool is ideally suited to tree change out operations, where pressure may be applied against a deep-set plug.

The setting tool provides a highly cost effective alternative to existing use of pyrotechnic setting tools. In the case of slickline operation, the slickline timer is powered by two AA cell lithium batteries, which do not require dangerous goods certification for transportation. This feature, combined with the short overall length of the tool, makes it ideal for transportation by helicopter.

The illustrated embodiment provides a detachable connection between the low pressure piston and the high pressure piston, and taking the form of a shear pin. However, it is within the scope of the invention to provide a hydraulic connection between the low pressure piston and the high pressure piston, and which couples these pistons together, and is adjustable from piston to piston to provide required output.

If there is insufficient pressure available in the wellbore, a reservoir may be provided to increase the activating pressure supplied to the tool. The reservoir may take the form of a nitrogen gas pressure bottle or accumulator, screwed onto the top of the tool.

What is claimed is:

1. A hydraulically operated setting tool for use in setting a plug or other component in a wellbore, said tool being responsive to a supply of input actuating pressure to actuate the tool, and compromising;

an elongate housing which is moveable lengthwise during lowering and raising movement of the tool in the wellbore, said housing having an inlet to receive the supply of actuating pressure;

an actuator element axially displaceable relative to the housing and engageable with said component to set and release said component with respect to the wellbore; and a pressure multiplier arrangement comprising at least two linked but independent pressure generating members in the housing and operative, upon supply of actuating pressure to the housing, to provide a low pressure high volume output to perform the initial loading of the tool, and a high pressure, low volume output to provide a multiplied hydraulic force applied to the actuator element to set said component in a required position in the wellbore.

2. A setting tool according to claim 1, in which the pressure multipler arrangement comprises a low pressure piston and a high pressure piston connected together by a detachable connection, such connection yielding under a predetermined load in order to allow the high pressure piston to apply the multiplied hydraulic force to the actuator element.

3. A setting tool according to claim 2, including a ratchet arrangement in the housing which is operative to prevent return movement of the low pressure piston after yielding of said connection.

4. A setting tool according to claim 2, in which the low pressure piston is an annular piston, and the high pressure piston is a rod-like piston.

5. A setting tool according to claim 1, in which the pressure multiplier arrangement comprises a low pressure piston and a high pressure piston connected together by a hydraulic connection, which is operative to couple the high pressure piston to the low pressure piston, and vice versa, to provide required output.

6. A setting tool according to claim 1, in which the housing has an inlet for receiving wellbore pressure to actuate the tool.

7. A setting tool according to claim 1, in which the housing is arranged to receive a supply of actuating pressure routed from the surface of the wellbore.

8. A setting tool according to claim 1, in which a connector module is connected to an upper end of the housing, and is operative to raise and lower the tool.

9. A setting tool according to claim 8, in which the connector module is one of: a) an adapter connectable to an electric wireline cable; b) a memory clock type device connectable to a slickline; or c) a hydraulic connector for use at shallow drilling depth and connectable to a surface supply of actuating pressure.

10. A setting tool according to claim 1, including a reservoir of additional pressure provided on the tool, and operative to apply additional actuating pressure when necessary, in order to actuate the tool.

11. A setting tool according to claim 1, including a shear stud projecting downwardly from the housing and engageable with said component.

12. A setting tool according to claim 11, in which the shear stud is provided on a plug adapter connected to a lower end of the tool housing.

13. A method of setting a plug or other component in a wellbore, utilizing a tool according to claim 1.

* * * * *